United States Patent [19]

Focke

[11] 4,350,002

[45] Sep. 21, 1982

[54] PROCESS AND APPARATUS FOR PACKING INDIVIDUAL ARTICLES, IN PARTICULAR BOTTLES, ONE INTO EACH PACKAGE

[75] Inventor: Heinz H. Focke, Verden, Fed. Rep. of Germany

[73] Assignee: Focke & Co., Verden, Fed. Rep. of Germany

[21] Appl. No.: 145,536

[22] Filed: May 1, 1980

[30] Foreign Application Priority Data

May 5, 1979 [DE] Fed. Rep. of Germany ..... 2918139

[51] Int. Cl.[3] ..... B65B 21/26; B65B 39/14

[52] U.S. Cl. ..... 53/449; 53/461; 53/49; 53/170; 53/211; 53/242; 53/252

[58] Field of Search ..... 53/49, 449, 461, 170, 53/175, 176, 211, 242, 252, 234

[56] References Cited

U.S. PATENT DOCUMENTS

| | | | |
|---|---|---|---|
| 2,971,636 | 2/1961 | Engleson et al. | 53/234 X |
| 3,056,246 | 10/1962 | Lyon et al. | 53/49 |
| 3,611,670 | 10/1971 | Baroin et al. | 53/242 X |
| 3,821,874 | 7/1974 | Jones | 53/252 X |
| 3,839,842 | 10/1974 | Kobayashi et al. | 53/242 X |
| 3,978,639 | 9/1976 | Ferrozzi | 53/449 |
| 3,982,382 | 9/1976 | Vogel | 53/252 |
| 4,245,452 | 1/1981 | Fujio | 53/234 X |

*Primary Examiner*—Horace M. Culver

*Attorney, Agent, or Firm*—Sughrue, Mion, Zinn, Macpeak & Seas

[57] ABSTRACT

A process for packaging individual articles, particularly bottles, into individual packages, specifically gift wrappings, in which the bottles are revolved with a lower rotating turret below an upper rotating turret holding the corresponding packages. The bottom end of the packages are left open and the bottles are inserted thereinto by lifting through the open bottoms. Before insertion of the bottles into the corresponding packages, the bottles are wrapped with an inner liner on the lower turret.

9 Claims, 9 Drawing Figures

Figure 1:
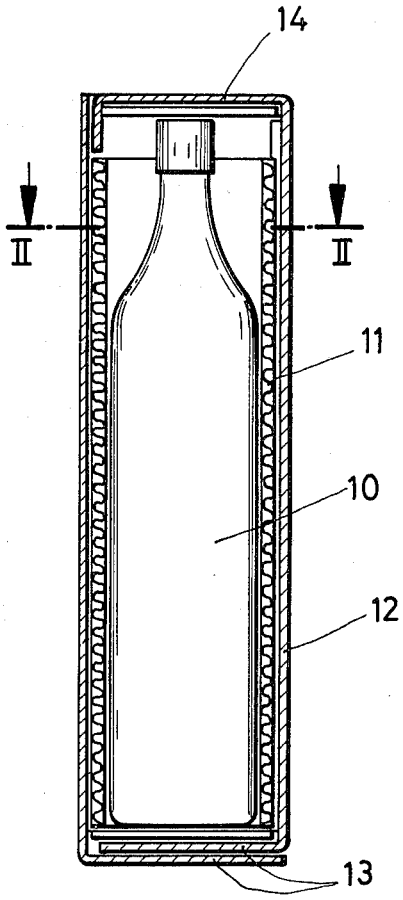

PROCESS AND APPARATUS FOR PACKING INDIVIDUAL ARTICLES, IN PARTICULAR BOTTLES, ONE INTO EACH PACKAGE

The invention relates to a process for packing individual articles, in particular bottles, one into each package (so-called gift wrap), using an apparatus which operates with revolving continuous conveyors for the articles and the packages in two planes one above the other in such a way that the article (bottle) is introduced from below by lifting into the open tubular package. The invention also relates to an apparatus for carrying out the abovementioned process.

Packages which each are to receive an individual bottle are known above all as gift wraps for high-quality spirits. The square-shaped packages enclose the contents of the package like a tube. The bottom and the top side of the package are customarily formed by flaps which are folded over one another and are to be opened.

In a known packing machine for the production of gift wraps of this type, bottles and packages which are open at the bottom are each conveyed along a continuous oval track. During the transport, the bottles are introduced by lifting into the packages which are open at the bottom. This is then followed by further packing engineering measures in order to finish the package.

Taking this as a starting point, it is the object of the invention to propose measures for the efficient packing of bottles or the like, having a so-called inliner, into individual packages of this type.

According to the invention, the process which achieves this object comprises providing the articles (bottles) during the transport in the (lower) feed plane with an inner wrap (inliner) and then introducing them together with the latter into the packages.

Inner wraps (inliners) of this type conventionally consist of corrugated board and serve to protect the contents of the package against shock loads. This inliner causes an additional packing engineering problem which is solved by the invention in such a way that the bottle or the like is introduced from below into the open package together and simultaneously with the inliner which beforehand has been placed around the bottle.

According to the invention, the inliner is placed around the bottle by rotating the bottle about its own upright longitudinal axis, while a blank for the inliner is held in position. This step is accomplished during the transport of the bottle along a part length of the lower circular transport back.

The apparatus according to the invention comprises two turrets which are rotatable about a common upright axis and of which a lower bottle turret serves to receive and transport the articles (bottles) over a section of the circumference and a package turret located above receives the packages in the empty and filled state.

According to the invention, the motions are matched in such a way that, along a quarter circle of the rotary motion of the bottle turret, the inliner is placed around the bottles and, during a further quarter circle, the bottles provided with the inliner can be introduced into the packages of the package turret.

Receivers, which are associated with the bottle turret and which can be rotated and lifted, one for each bottle, are designed in a special way. On the one hand, these enable the inliner to be fitted and, on the other hand, effect the transfer of the bottles to the packages.

Further details and features of the invention relate to the design of the bottle turret with the receivers and to that of the package turret and also to means which ensure an efficient and nevertheless gentle transfer of the bottles to the packages.

Figure 2:
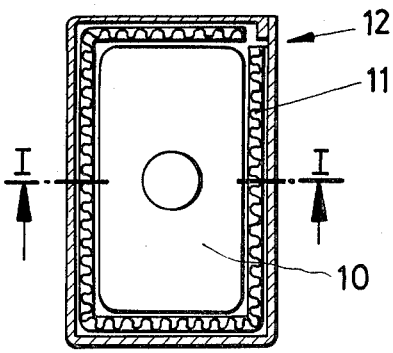
Figure 3:
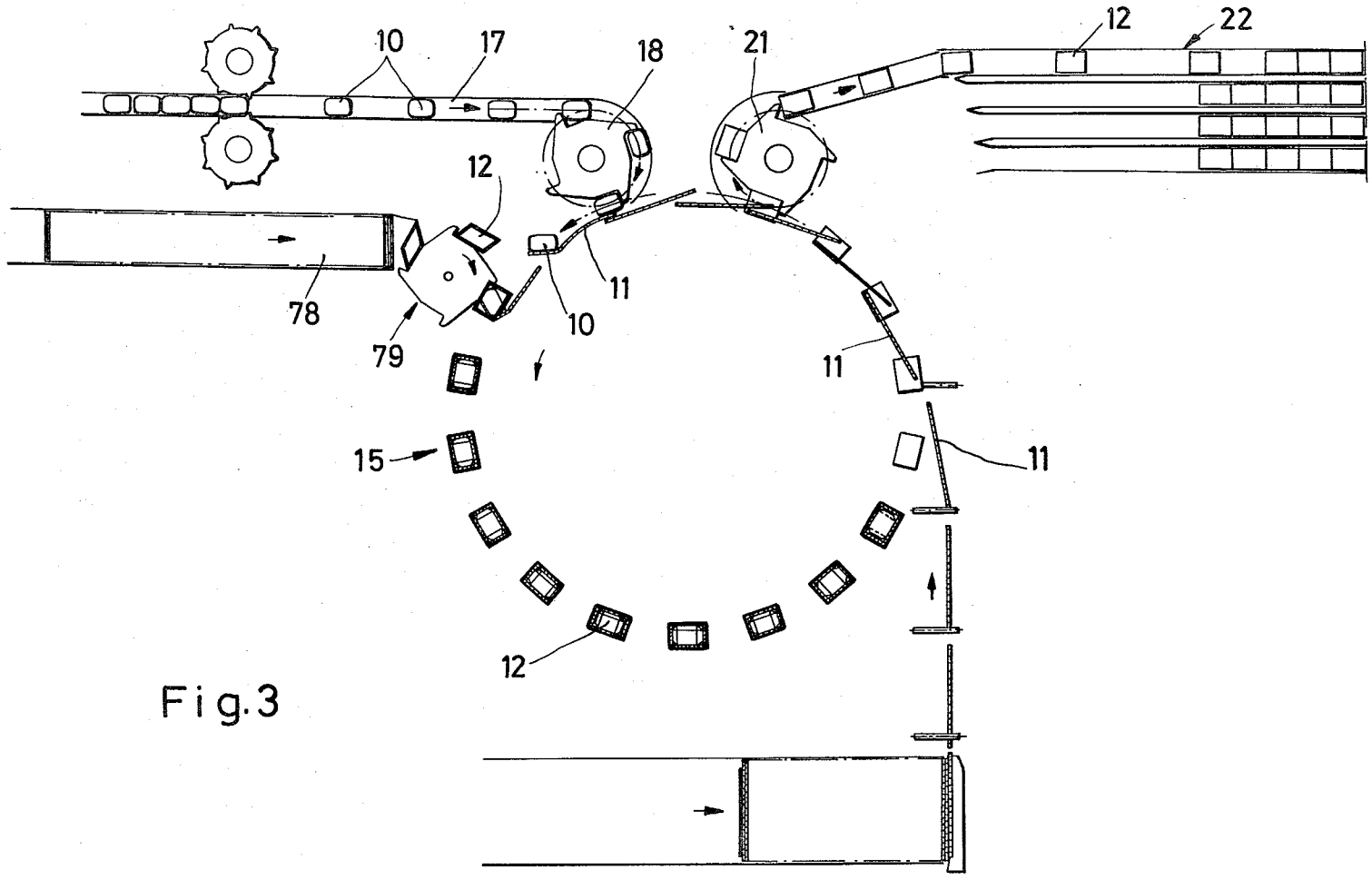
Figure 4:
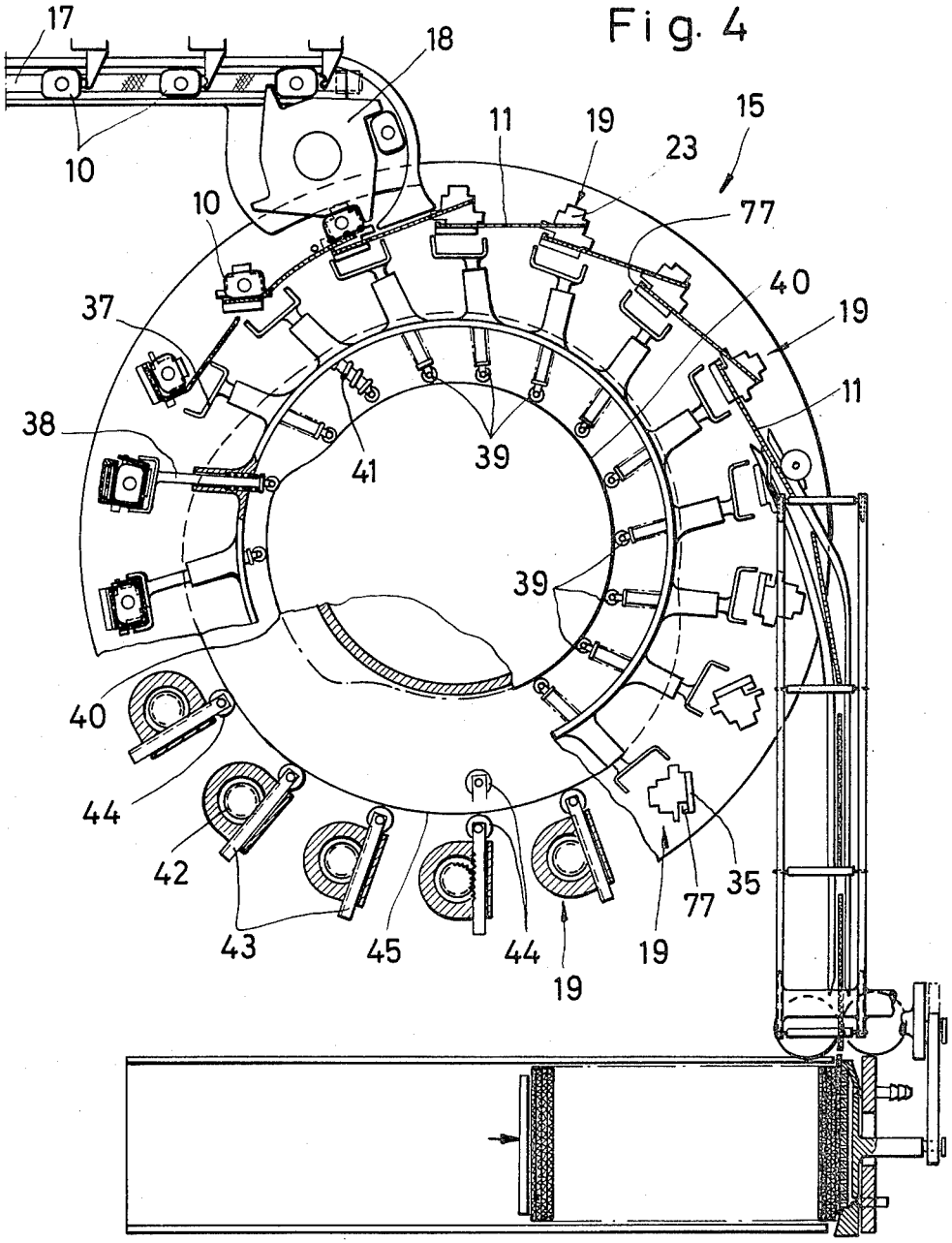
Figure 5:
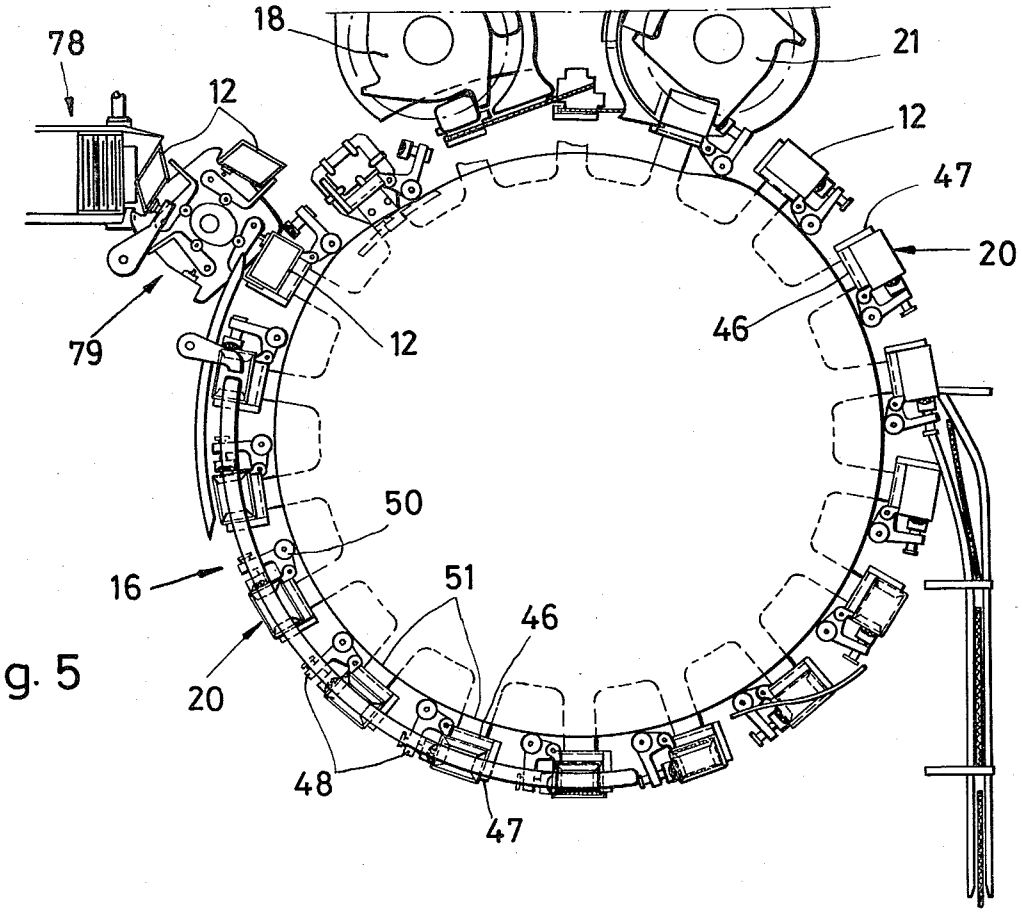
Figure 6:
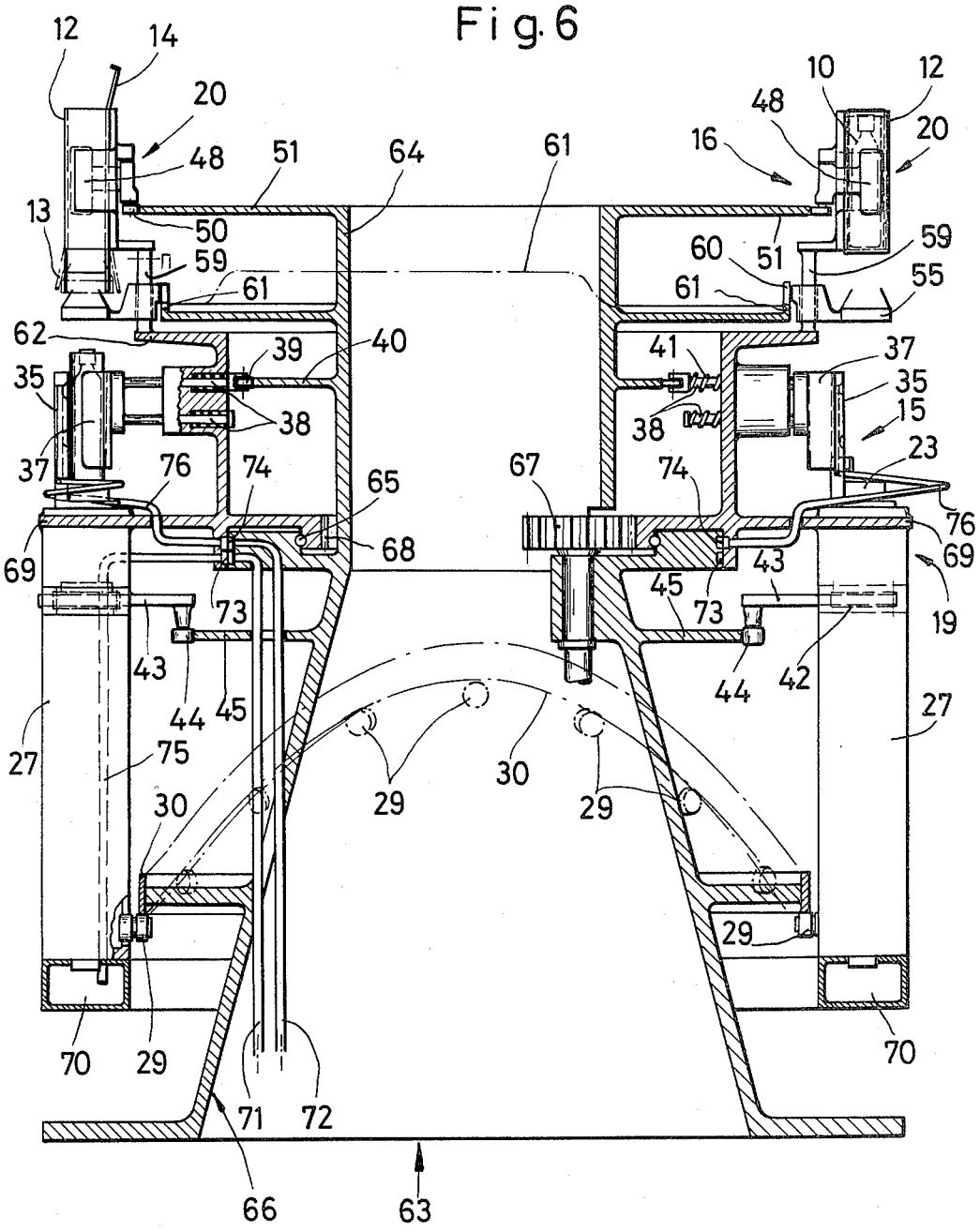
Figure 7:
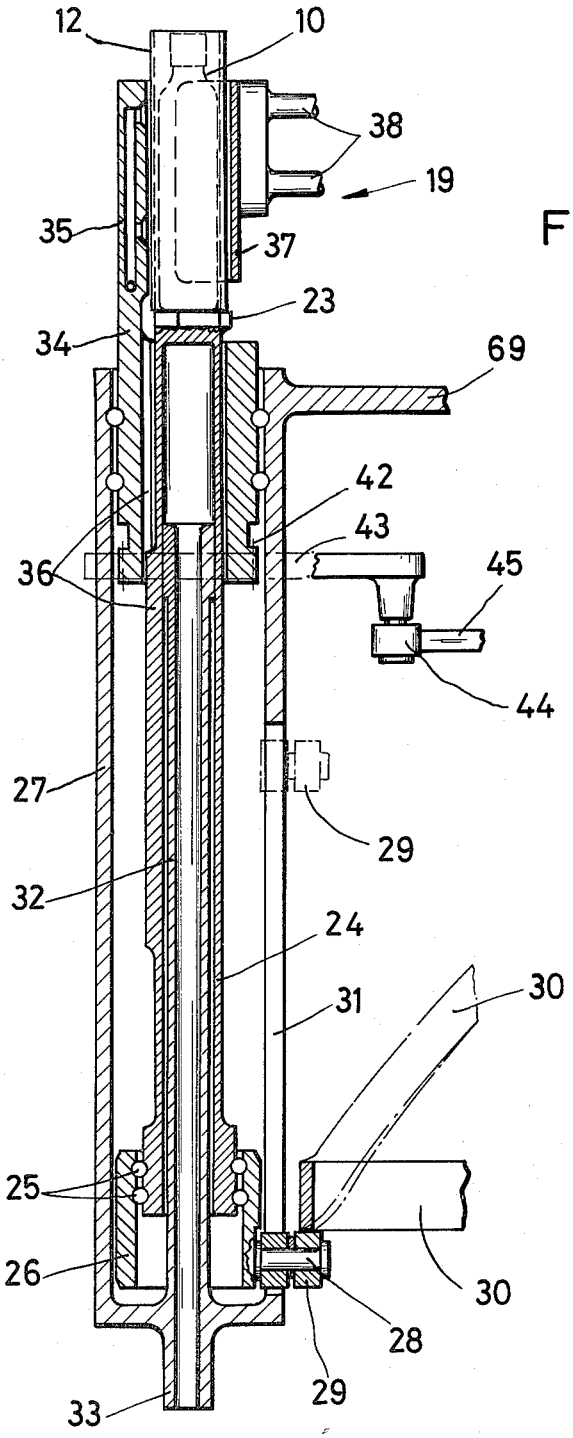
Figure 8:
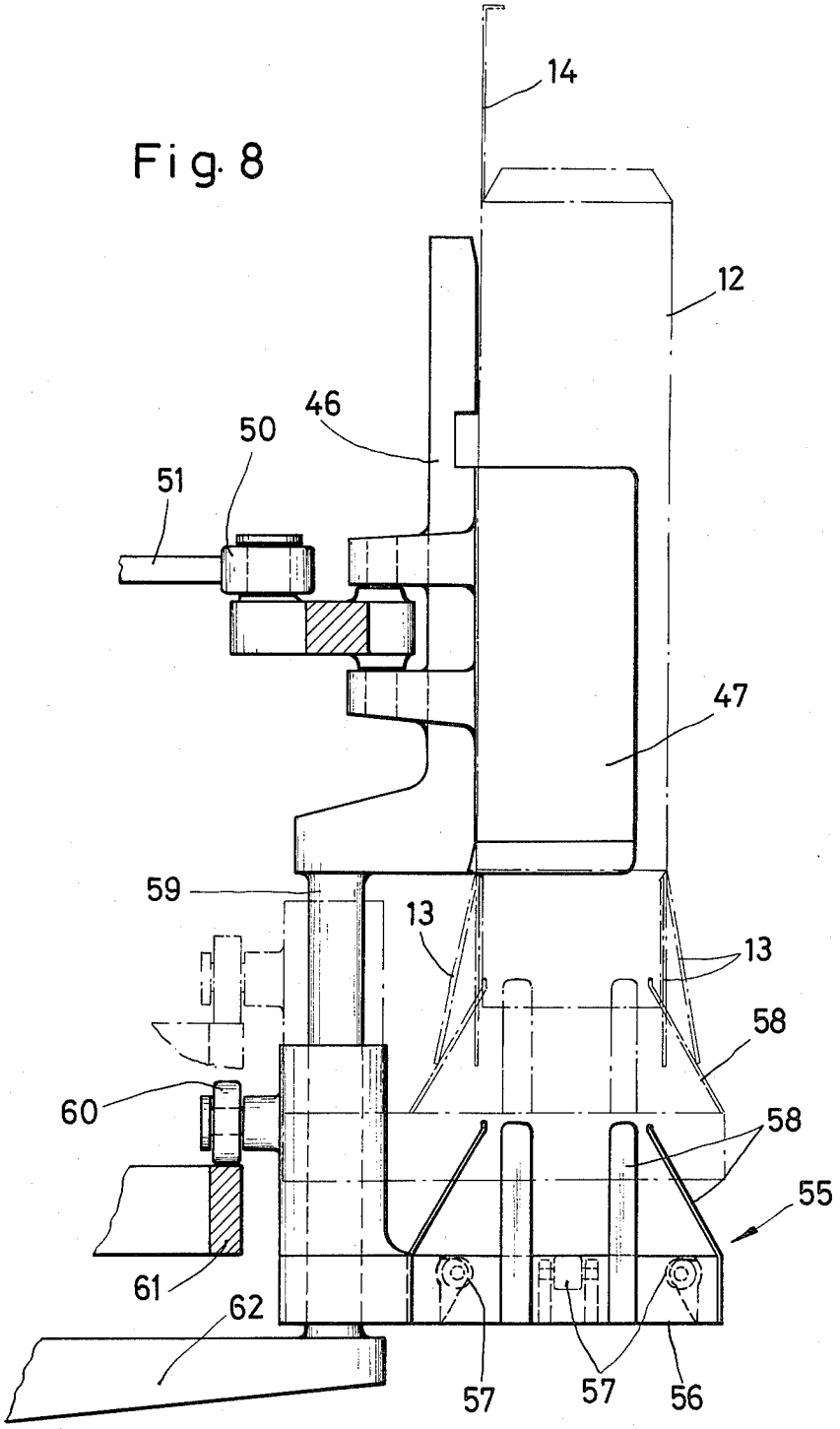
Figure 9:
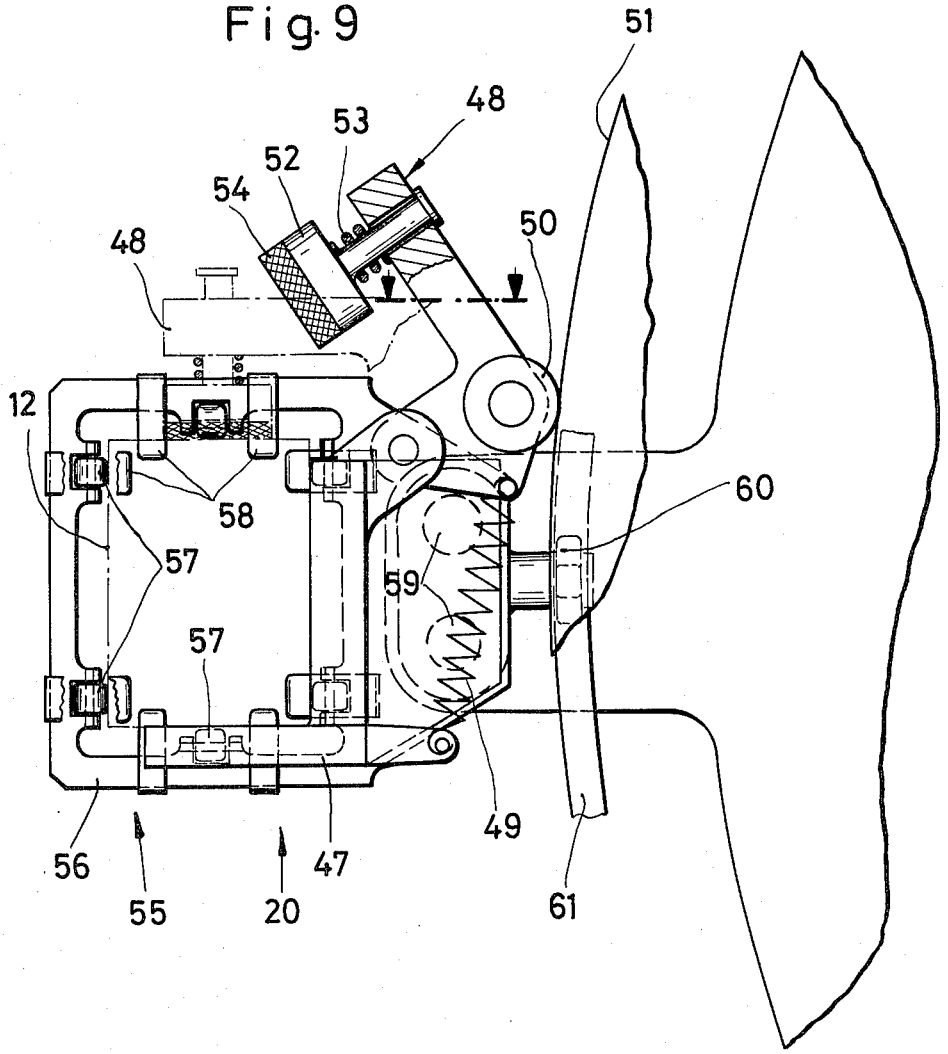

The invention is explained in more detail in the following text by reference to an illustrative embodiment of the apparatus. In the drawings:

FIG. 1 shows a package (so-called gift wrap) in vertical section, containing a bottle, FIG. 2 shows a horizontal section II—II of the package according to FIG. 1, FIG. 3 shows a diagrammatic depiction of a part of the apparatus for the production or filling of packages according to FIGS. 1 and 2, in the zone of a (lower) bottle turret, FIG. 4 shows the bottle turret with further details, likewise in plan, FIG. 5 shows a concentric package turret, arranged above the bottle turret, likewise in plan, FIG. 6 shows a central vertical section through the apparatus, FIG. 7 shows a detail of the apparatus, namely a rotating and lifting receiver for bottles, in vertical section on an enlarged scale, FIG. 8 shows a detail in the region of a package holder in the zone of the package turret in side view, on a further enlarged scale, and FIG. 9 shows a plan view corresponding to FIG. 8.

The type of package, primarily dealt with here, is represented diagrammatically in FIGS. 1 and 2. A bottle 10—a "square bottle" in the present case—is laterally wrapped by an inliner 11 which completely surrounds the bottle. This inliner consists in the present case of a blank of corrugated board. The bottle 10 and inliner 11 are accommodated in a package 12 which surrounds the content of the package like a tube and comprises the bottom flaps 13 as well as upper closing flaps 14.

The illustrative embodiment, shown here, of a packing machine is constructed and equipped in such a way that the inliner 11, consisting of a plane blank cut for the purpose, is fitted, namely placed around the bottle 10, and this complete content is then introduced from below into the package 12 which is open at the bottom. For this purpose, the apparatus is equipped with two circular working planes, namely a lower bottle turret 15 and a package turret 16 located above and on the same axis. The two turrets 15, 16 revolve at the same speed.

The unpackaged bottles 10 are fed to the bottle turret 15 via a bottle track 17 and are individually transferred to the bottle turret 15 by means of a cellular wheel 18. The bottle turret 15 is provided with a number of receivers 19, one for each bottle 10, located on the circumference of the bottle turret 15.

Moreover, plane blanks for forming the inliner 11 are fed to the bottle turret 15, approximately in the tangential direction. The blanks for the inliners 11 are each put down on a receiver 19 in a time sequence before the bottles 10.

After a bottle 10 has been fed to a receiver 19, the inliner 11 is placed around the bottle 10 by rotating the latter or the receiver 19 with the bottle 10. During this, that edge of the inliner 11 which initially is at the front in the conveying direction is held in the receiver 19.

This winding process for the inliner 11 takes place along about a quarter rotation of the bottle turret 15.

After the inliner 11 has been completed, the bottle 10 with this inliner 11 is introduced into the package 12, which is open at the bottom, by moving the particular receiver 19 upwards. The packages 12 which are folded open, that is to say they have a square or rectangular cross-section, are here held on the outer circumference of the package turret 16 by means of a special package holder 20, and in particular exclusively in the zone of the tubular shell. This step of introducing the bottles 10 with inliner 11 into the package 12 also takes place along approximately a quarter circle of the rotary motion.

After the packages 12 have been completed and, if desired, closed, they are taken off the upper package turret 16 by a cellular wheel 21 and are transferred to a discharge track 22.

The receivers 19 for the bottles 10 are designed in a special way. A lifting plate 23 of complex plan form serves as seating for one bottle 10 in each case. The lifting plate 23 is in turn located on the upper end of a lifting tube 24. The lower end of the latter is in turn rotatably mounted via a bearing 25 in a support bush 26 which in turn is accommodated in a casing 27 in such a way that it can be lifted but cannot be rotated. The lifting motions of the support bush 26 and hence of the lifting tube 24 are controlled from the outside, namely as a function of the rotary motions of the bottle turret 15. For this purpose, a transversely pointing journal 28 with a guide roller 29 is laterally fitted to the support bush 26. This guide roller is brought into contact with the underside of a stationary cam track 30. By exerting a steady pressure on the guide roller 29, the latter follows the outline of the cam track 30 as the bottle turret 15 rotates, and this has the consequence that the lifting tube 24 and hence the lifting plate 23 with the bottle 10 (and the inliner 11) are lifted. The guide roller 29 or its journal 28 then project from the casing 27 through an upright slot 31 in the latter.

In the present case, the requisite lifting force is generated pneumatically. For this purpose, a hollow spigot 32, which is joined to the casing 27, is mounted and guided in the lifting tube 24. This hollow spigot projects from the bottom of the casing 27 and forms a connection 33 for a compressed air source of, for example, 6 atmospheres gauge. The lifting tube 24 and hence the lifting plate 23 are thus always loaded in the upward direction, like a biased spring.

Moreover, in the upper zone, a support tube 34 for a flat holding plate 35, which projects from the casing 27, for the inliner 11 is rotatably mounted in the casing 27. The abovementioned support tube 34 is coupled via a splined joint 36 to the lifting tube 24 in such a way that the lifting tube 24 and the support tube 34 are rotated together, but the former can also be moved vertically independently of the support tube 34.

The holding plate 35 located next to the lifting plate 23, is provided with suction holes, by means of which the inliner 11 fed to the receiver 19 is gripped. The receiver 19, namely the holding plate 35, is furthermore provided with a lateral stop 77 for that edge of the inliner 11 which is in front in the conveying direction, so that the inliner always assumes an exact, recurring relative position in the receiver 19. After the bottle 10 has been put down on the lifting plate 23, the latter and the holding plate 35 rotate clockwise (relative to FIG. 4), during which the projecting part of the inliner 11, taken up between the holding plate 35 and the bottle 10, is placed around the bottle 10.

The above winding and folding-over process is supported or completed by special U-holders 37, each of which is associated with one receiver 19. The U-holders 37 located on the radially inner side of the bottle turret 15 are mounted on rams 38 and can be shifted in a direction which slightly deviates from the radial direction in such a way that, during the final phase of wrapping around, the inliner 11 is gripped, placed against the bottle 10 and held in this position in the further course of the process. Accordingly, the U-holders 37 also have the function of temporarily holding the inliner 11 on the bottle 10.

On their radially inner end, the rams 38 are provided with a feeler roll 39 which rolls on a stationary cam disc 40 and determines the appropriate relative position of the U-holder 37 against the pressure of a spring 41.

The rotary drive of the lifting plate 23 and of the parts connected thereto is effected by driving the support tube 34. The latter is (in the casing 27) provided with a gear rim 42. The latter is in engagement with a rack 43 which enters the casing 27 and can be moved to and fro. The rack 43 is shaped as a ram which protrudes from the casing 27 and has a runner 44. The latter makes contact with a stationary cam 45 which, accordingly, controls the rotary motions of the lifting plate 23.

The package holders 20 of the package turret 16 are constructed essentially in the shape of a U and have a radially inner support wall 46 and a further support wall 47 which, in the present case, is in front in the conveying direction. An elastic pressure element in the form of a contact pressure lever 48 is pivotably mounted opposite the support wall 47. By bearing against a side wall of the package 12, this lever determines the holding force with which the package is held in the package holder 20. The contact pressure lever 48 which is pivotable against a tension spring 49 is also controlled with respect to its relative position by a stationary cam disc 51 via a guide roller 50. A contact pressure jaw 52 of the contact pressure lever 48 is in turn mounted on the contact pressure lever 48 to be elastically movable by means of a compression spring 53 and is additionally provided with an elastic pad 54 which comes directly into contact with the package 12. The cam disc 51 for moving the contact pressure lever 48 is designed in such a way that, after the package 12 has received the bottle 10, the contact pressure is increased to enable the package holder 20 to cope with the greater dead weight of the package 12 with contents.

The prepared packages 12 are taken in the flat folded-up state from a package magazine 78 and are transferred by a rotatable intermediate turret 79 to the package turret 16. The intermediate turret 79 is provided with tools for erecting the package 12 into the three-dimensional, sleeve-like shape so that the packages 12 transferred to the package turret 16 have a rectangular or square cross-section.

To facilitate the introduction of the bottle 10 into the package 12, a mouthpiece 55, which can be lifted and lowered, is arranged on the lifting path between the bottle turret 15 and the package turret 16. This mouthpiece consists of a (rectangular or square) closed frame 56, through which the bottle 10 (with inliner 11) passes. Within the frame 56, contact rollers 57 are provided on four opposite sides for guiding the bottle 10 or the inliner 11, during the through movement. Above the frame 56 and connected thereto, there are resilient tongues 58 (of spring steel or the like) which are bent inwards. These tongues 58, likewise located on four opposite sides and angled off inwards, enter the lower zone of the package 12 or the zone of the bottom flaps 13 in such a way that the latter are slightly bent outwards during the introduction of the bottle 10 with inliner 11, but in any case do not impair the insertion step.

The mouthpiece 55 of this shape is mounted, so that it can be moved to different heights, on guide rods 59 which are fitted on the underside of the package holder 20. Moreover, the mouthpiece 55 also has a guide roller 60 which runs on a cam ring 61 in order to control the up-and-down motions of the mouthpiece 55. At the same time, the guide rods 59 have the function of carriers for the package holder 20, in particular since the lower end of the guide rods 59 is connected to a radially-pointing support flange 62.

The turrets 15 and 16 and the other units described above are fitted to a common central support frame 63 (FIG. 6). An upper support cylinder 64 is mounted rotatably (bearing 65) on a lower conical base 66. The support cylinder 64 which carries the bottle turret 15 and the package turret 16 is driven by a pinion 67 via an internal gear rim 68.

The receivers 19 for the bottles 10, or their casings 27, are fitted in suspension to the underside of a turret disc 69. The lower ends of the casings 27 are mutually connected by a hollow ring 70 which revolves with them. The compressed air for lifting the lifting plate 23 is fed to the casings 27 via this ring.

Stationary lines 71 and 72 are provided for applying compressed air and suction air to the appropriate elements. These lines end in ring mains 73, 74 which are formed in the zone between a stationary part and a revolving part. Connecting lines 75 and 76, associated with each turret station, for compressed air and suction air are in turn connected to the ring mains 73, 74. The connecting line 76 for supplying suction air to the holding plate 35 is of elastically deformable design so that it is able to follow the rotary motions of the holding plate 35.

I claim:

1. A method for packaging individual objects, in particular bottles, into a package in which the objects to be packed are wrapped with an inner liner, comprising the steps of:

(a) moving the objects (10) to be packaged in an upright position along a first path (15) in a lower plane and moving packages (12) along a second path in an upper plane on a higher level than said lower plane;

(b) fitting said objects (10) into said inner liners (11) as said objects are moved along said first path and wrapping said objects (10) with said inner liners (11);

(c) lifting said objects (10) and the inner liners (11) in which said objects (10) are wrapped upwardly and inserting said objects (10) with their respective inner liners (11) into correspondingly positioned packages (12) through openings in the bottoms of said packages (12) as said objects (10) and said packages are moved along said first and second paths, respectively.

2. The method according to claim 1, wherein said step of wrapping said objects (10) with said inner liners (11) comprises rotating said objects (10) around their vertical axes while a blank for the corresponding inner liner (11) is held in a stationary position.

3. The method according to claim 1, wherein said first and second paths are circular, and wherein said method further comprises the steps of feeding blanks corresponding to said inner liners (11), said objects (10), and said packages (12) toward said circular paths in a direction in which said objects (10) and said packages (12) are moved along said circular paths, and extracting completed packages at a point where each package (12) has undergone nearly a complete rotation.

4. The method according to claim 3, wherein said objects (10) and said packages (12) are conveyed along said circular paths using revolving continuous conveyors, one conveyor being provided for said objects (10) and the other for said packages (12), said revolving continuous conveyor for said packages (12) being disposed vertically above said revolving continuous conveyor for said objects (10), and wherein said objects (10) are introduced into corresponding packages (12) from below by lifting said objects (10) into the corresponding packages (12) through an open bottom of said packages (12), said revolving continuous conveyors being rotated around a common vertical axis.

5. The method according to claim 4, wherein said objects (10) are transferred into the corresponding packages (12) while being rotated along approximately a quarter of a circumference of a circle.

6. The method according to claim 5, wherein said inner liners (11) are disposed around the corresponding objects (10) during transport of said objects (10) upon said second revolving continuous conveyor during transport around approximately a quarter circle of rotation of said second revolving continuous conveyor.

7. The method according to claim 5, wherein said second revolving continuous conveyor comprises a bottle turret (15) provided with a plurality of receivers (12), said receivers (19) being rotatable and liftable, wherein said objects (10) comprise bottles, and wherein one of said receivers (19) is provided for each bottle.

8. The method according to claim 7, wherein each said receiver (19) comprises a holder (35) and means for applying a vacuum to said holder, said holder being rotatable with the corresponding receiver (19) for momentarily holding a blank for said inner liner (11) during transport and wrapping.

9. The method according to claim 7, wherein each said receiver (19) is provided with a mechanical holder (37) which revolves with said bottle turret (15) for completing wrapping of said inner liner (11) and to hold said inner liner (11) around the corresponding bottle until the bottle is transferred to the corresponding package (12).

* * * * *